US009702210B2

(12) United States Patent
Dirksen et al.

(10) Patent No.: US 9,702,210 B2
(45) Date of Patent: Jul. 11, 2017

(54) WELLBORE DRILLING USING DUAL DRILL STRING

(71) Applicant: Halliburton Energy Services Inc., Houston, TX (US)

(72) Inventors: Ron J. Dirksen, Spring, TX (US); Derrick W. Lewis, Conroe, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/426,884

(22) PCT Filed: May 6, 2014

(86) PCT No.: PCT/US2014/036985
§ 371 (c)(1),
(2) Date: Mar. 9, 2015

(87) PCT Pub. No.: WO2014/182709
PCT Pub. Date: Nov. 13, 2014

(65) Prior Publication Data

US 2016/0047187 A1 Feb. 18, 2016

Related U.S. Application Data

(60) Provisional application No. 61/820,059, filed on May 6, 2013.

(51) Int. Cl.
*E21B 33/038* (2006.01)
*E21B 33/064* (2006.01)
(Continued)

(52) U.S. Cl.
CPC ..... *E21B 21/12* (2013.01); *E21B 7/124* (2013.01); *E21B 21/08* (2013.01); *E21B 21/103* (2013.01);
(Continued)

(58) Field of Classification Search
CPC ..... E21B 21/12; E21B 21/103; E21B 33/064; E21B 33/038; E21B 7/124; E21B 21/08;
(Continued)

(56) References Cited

U.S. PATENT DOCUMENTS 3,259,198 A * 7/1966 Montgomery ..... E21B 7/128 175/215
7,150,324 B2 12/2006 Laursen et al.
(Continued)

FOREIGN PATENT DOCUMENTS

WO WO-2008058209 A2 5/2008

OTHER PUBLICATIONS

Search Report and Written Opinion of the International Searching Authority, Sep. 29, 2014, 13 pages; Korean International Searching Authority.
(Continued)

*Primary Examiner* — James G Sayre

(57) ABSTRACT

A method and apparatus are disclosed for drilling a wellbore using a concentric dual drill string. Multiple individually selectively isolable crossover ports intervaled may be provided along the length of the drill string thereby facilitating pumping a well control fluid within a wellbore annulus without the need to run-in or trip-out the drill string. Multiple one way check valves may be included at various points within an inner pipe of the dual drill string to minimize settling of particulate matter during long periods of non-circulation. In an offshore arrangement, the drill string may be used without a marine riser. A rotating control device is provided, and a hydraulic power unit is located at the seafloor for controlling and lubricating the rotating control device. A pump may be located at the seafloor for managing wellbore annulus pressure via the rotating control device.

21 Claims, 7 Drawing Sheets

(51) Int. Cl.

| | |
|---|---|
| ***E21B 7/124*** | (2006.01) |
| ***E21B 21/10*** | (2006.01) |
| ***E21B 21/12*** | (2006.01) |
| ***E21B 33/08*** | (2006.01) |
| ***E21B 21/08*** | (2006.01) |

(52) U.S. Cl.
CPC ..... *E21B 33/038* (2013.01); *E21B 33/064* (2013.01); *E21B 33/085* (2013.01)

(58) Field of Classification Search
CPC ..... E21B 7/12; E21B 15/02; E21B 21/001; E21B 33/047
See application file for complete search history.

(56) References Cited

U.S. PATENT DOCUMENTS 8,261,826 B2 9/2012 Lovorn et al.
2004/0140129 A1* 7/2004 Gardes ..... E21B 7/04 175/57
2006/0065402 A9* 3/2006 Fontana ..... E21B 7/12 166/358
2008/0060846 A1* 3/2008 Belcher ..... E21B 17/042 175/25
2008/0078558 A1 4/2008 Dallas
2009/0236144 A1* 9/2009 Todd ..... E21B 17/01 175/5
2011/0024195 A1* 2/2011 Hoyer ..... E21B 21/00 175/65
2011/0180269 A1 7/2011 Vestavik
2011/0300008 A1 12/2011 Fielder et al.
2012/0000664 A1* 1/2012 Nas ..... E21B 33/085 166/344
2012/0125686 A1* 5/2012 Hogseth ..... E21B 17/003 175/40
2012/0292106 A1* 11/2012 Orbell ..... E21B 17/085 175/5

OTHER PUBLICATIONS

European Patent Office, Supplementary European Search Report, Nov. 16, 2016, 9 pages, Europe.

* cited by examiner

WELLBORE DRILLING USING DUAL DRILL STRING

CROSS REFERENCE TO RELATED APPLICATIONS

The present application is a U.S. national stage patent application of International Patent Application No. PCT/US2014/036985, filed on 6 May 2014, which claims priority of U.S. Provisional Patent Application No. 61/820,059, entitled, "METHOD AND SYSTEM FOR SUBSEA RISERLESS DRILLING," filed May 6, 2013, the benefits of which are claimed and the disclosures of which are incorporated herein by reference in their entirety.

FIELD

The present disclosure relates generally to oilfield equipment, and in particular to drilling systems, and drilling techniques for drilling wellbores in the earth. More particularly still, the present disclosure relates in part to offshore drilling techniques and systems.

BACKGROUND

Various drilling methods and systems are known in the art. Most arrangements use a rotating drill bit that is carried and conveyed in the wellbore by a drill string, which is in turn carried by a drilling rig located above the wellbore. The drill bit may be rotated by the drill string, and the drill string may also include as part of a bottom hole assembly downhole rotary motor for rotating the drill bit.

The drill string is substantially made up of individual stands of drill pipe that are assembled as the drill bit advances into the earth. Drilling fluid is pumped to the drill bit through the drill string and is directed out of nozzles in the drill bit for cooling the bit and removing formation cuttings. The drilling fluid may also serve the purpose of providing hydraulic power to downhole tools, such as a mud motor located in a bottom hole assembly (BHA) for rotating the drill bit. The spent drilling fluid and entrained formation cuttings are forced from the bottom of the wellbore and carried upwards through the annulus that exists between the drill string and the wellbore wall.

In cases of drilling offshore wells, the drilling rig is positioned above the surface of the water, generally over the wellbore. A riser is commonly provided between the drilling rig and the wellbore at the seafloor for allowing the drill string to be conveniently run into and tripped out of the wellbore. The riser also provides an extension of the annular wellbore flow path for returning the drilling fluid and cuttings to the rig for processing and reuse.

Recently developed drilling methods and systems may substitute a coaxial dual drill string in place of the prolific single-pipe drill string. A coaxial dual drill string has an inner pipe fixed within an outer pipe, thereby defining an inner flow channel within the inner pipe and an outer flow channel within the annular region defined between the inner and outer pipes.

In such arrangements, drilling fluid may be supplied to the drill bit via the outer flow channel, and the return drilling fluid, laden with formation cuttings, may be removed from the wellbore via the inner flow channel. A single crossover port may be provided at a distal end of the drill sting, commonly at a location just uphole of the BHA, if supplied, which fluidly connects the inner flow path to the wellbore, thereby allowing spent drilling fluid at the bottom of the wellbore to re-enter the drill string and return uphole via the inner flow channel.

The use of a dual drill string as has been generally described includes a flow channel for return drilling fluid flow and may provide several advantages over drilling with single-pipe drill string. In certain offshore conditions, such a system may obviate the need to deploy a drilling riser, provided an alternative barrier between the seawater and the wellbore annulus is established. The return flow channel leaves the wellbore clear of formation cuttings. Improved hole cleaning results in less downtime. Finally, because the entire wellbore annulus no longer forms a flow path for drilling fluid circulation, the fluid within the wellbore annulus is essentially static, which may be preferable for certain techniques for managing wellbore pressure.

BRIEF DESCRIPTION OF THE DRAWINGS

Embodiments are described in detail hereinafter with reference to the accompanying figures, in which.

DETAILED DESCRIPTION

Figure 1:
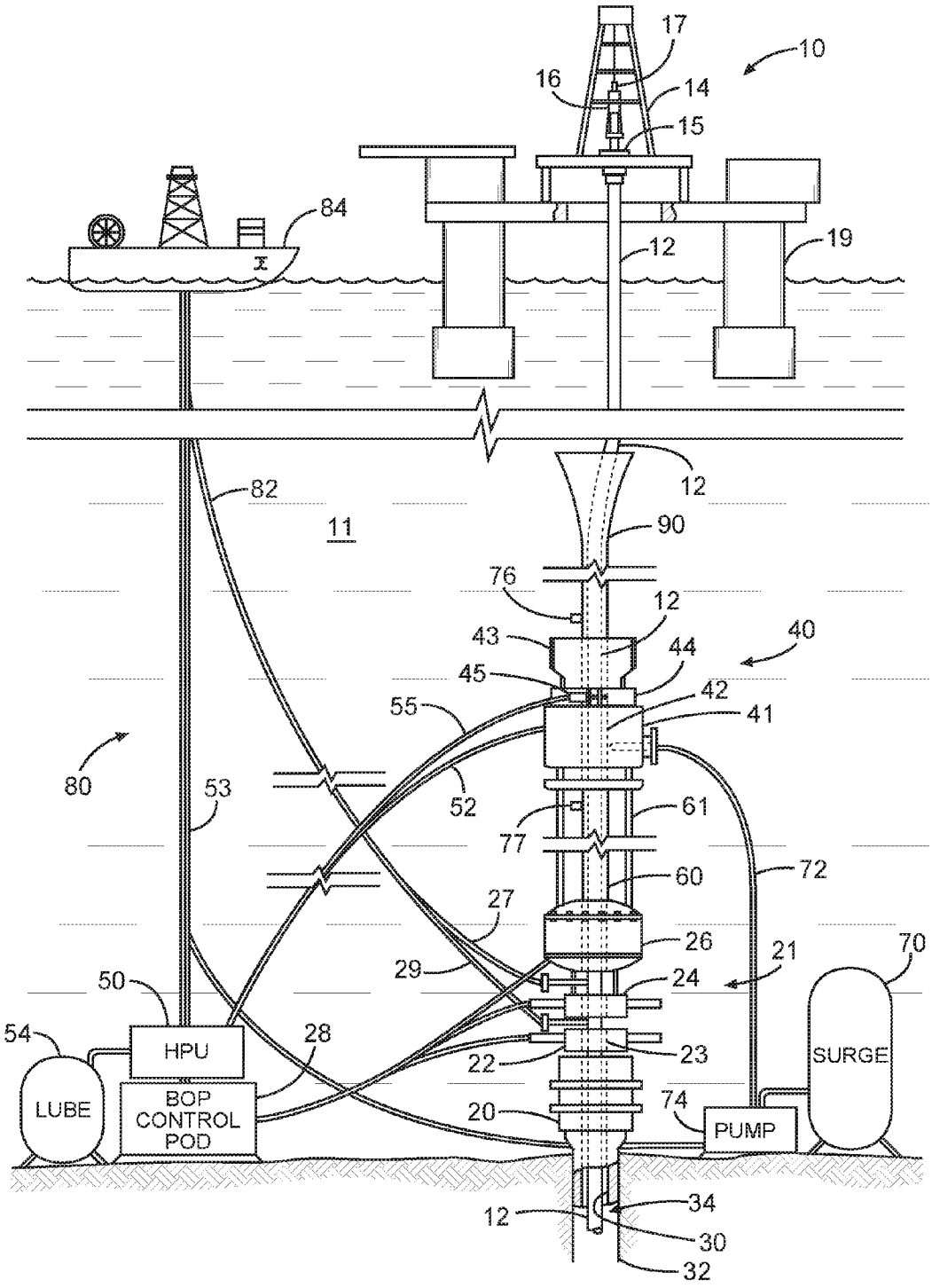
FIG. 1 is an elevation view in cross section of a riserless dual drill string drilling system according to an embodiment, showing a dual drill string extending from an offshore platform to a wellhead and subsea stack at the seafloor and associated support components.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe relationships as illustrated in the figures. The spatially relative terms are intended to encompass different orientations of the apparatus in use or operation in addition to the orientation depicted in the figures.

FIG. 1 is an elevation view in partial cross section of a riserless dual drill string drilling system 10 according to an embodiment. Referring to FIG. 1, drilling system 10 includes a drilling rig 14, which may include a rotary table 15, a top drive unit 16, a hoist 17, and other equipment necessary for drilling a wellbore in the earth.

In the embodiment of FIG. 1, drilling system 10 includes an offshore platform 19 located at the surface of a body of water 11. Offshore platform 19 may be a tension leg platform, spar, semi-submersible, or drill ship, for example. In other embodiments, the drilling system of the present disclosure may be located onshore.

Drilling rig 14 may be located generally above a wellhead 20, which in the case of the offshore arrangement of FIG. 1 is located at the seafloor of body of water 11. Drilling rig 14 suspends a concentric dual drill string 12, which extends downward through body of water 11, through a passage 30 formed through wellhead 20, and into the wellbore 32 that is being drilled. The annular region between the wall of wellbore 32 and the exterior wall of dual drill string 12 defines a wellbore annulus 34.

Wellhead 20 ideally carries a blowout preventer (BOP) stack 21, which may include ram BOPs 22, 24 and an annular BOP 26, for example. BOPs 22, 24, 26 include an axial passage 23 to accommodate drill string 12 and are arranged with closure devices, such as shear, blind or pipe rams in the case of ram BOPs 22, 24, or elastomeric packers, in the case of annular BOP 26, to shut in wellbore 32 in the case of an emergency. A BOP control pod 28 may be located in proximity to wellhead 20, for example on the seafloor, for redundant actuation of BOP stack 21. Hydraulic choke and kill lines 27, 29 are also ideally provided to BOP stack 21 for emergency well pressure control.

A rotating control device (RCD) 40, also referred to by routineers as a rotating control head, rotating blowout preventer, or rotating diverter, is carried atop BOP stack 21. RCD 40 has a housing 41 with an axial passage 42 formed therethrough for accommodating drill string 12. As discussed in greater detail below with respect to FIG. 3, RCD 40 includes a rotatable seal assembly 43, which may include one or more elastomeric sealing elements and a bearing assembly, for example. Seal assembly 43 creates a dynamic seal between the outer wall of drill string 12 and housing 41 thereby fluidly isolating wellbore annulus 34 from body of water 11 while allowing drill string 12 to axially translate and rotate. RCD 40 may be an active- or passive-style device, and it may also take the form of an annular BOP.

A subsea hydraulic production unit (HPU) 50 is provided on the seafloor in proximity to RCD 40. HPU 50 is fluidly coupled to RCD 40 via one or more lubrication conduits 52 to selectively provide hydraulic lubrication to seal assembly 43 and/or the outer wall of drill string 12 immediately above and/or below the sealing element of RCD 40. In particular, suitable lubrication may be achieved by providing lubricant at or near the top of the sealing element when drill string 12 is run into wellbore 32 (including drilling operations) and at or near the bottom of the sealing element when drill string 12 is tripped out of wellbore 32. HPU 50 may be a closed circulation system, or it may be dead head lubrication system, for example.

In one or more embodiments, seawater supplied from body of water 11 may be used as a lubricant for cooling and lubrication of RCD seal assembly 43. If additional lubricity is required, it may be provided by using alternative lubricating fluid or by mixing the seawater with a suitable additive, such as an environmentally sensitive detergent. Such an additive or lubricant may be supplied to HPU 50 by a feed line 53 from the surface of body of water 11 or a tank 54 located at the seafloor.

The scaling element of RCD 40 may be a consumable item that needs replacement during drilling operations. Accordingly, seal assembly 43 is preferably designed to be removable from housing 42 and carried to or from the surface of body of water 11 by drill string 12. A removable clamp 44 holds seal assembly 43 in place within or against RCD housing 42 against the fluid pressure of wellbore annulus 34. Clamp 44 may include an actuator 45 that can be remotely operated. In one or more embodiments, HPU 50 may selectively operate actuator 45 of RCD clamp 44. For example, actuator 45 may be a hydraulic piston-cylinder assembly or a hydraulic motor, and HPU 50 may be fluidly coupled to actuator 45 via hydraulic conduit 55.

Figure 2:
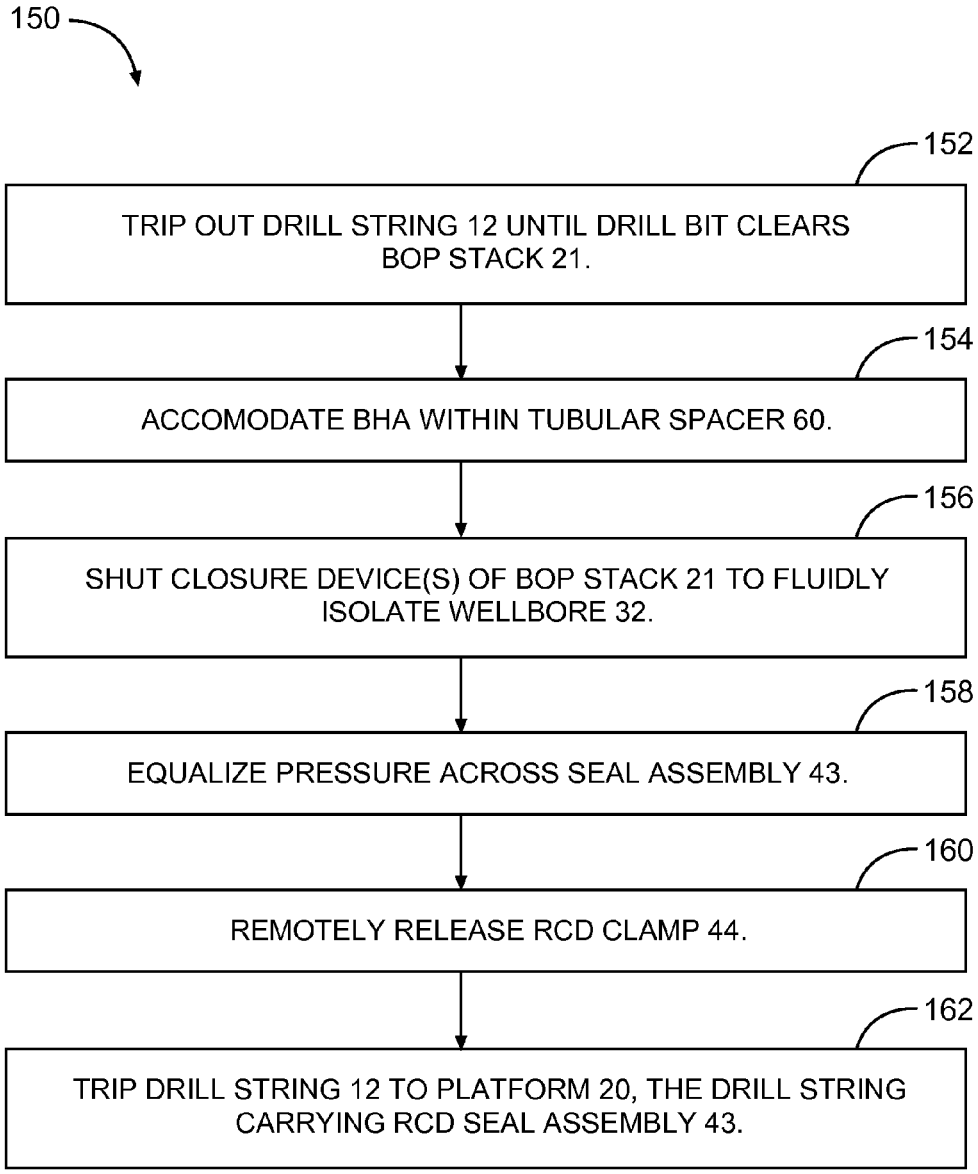
FIG. 2 is a flowchart that outlines the steps of a method according to an embodiment for remotely replacing a seal assembly of a rotating control device of the drilling system of FIG. 1.

FIG. 2 is a flowchart that outlines the steps of a method 150 for replacing seal assembly 43. Referring to both FIGS. 1 and 2, at step 152, drill string 12 is raised by drilling rig 14 until drill bit 212 (FIG. 5) carried at the distal end of drill string 12 is located above the closure devices, i.e., the rams and/or the annular packer, of BOP stack 21.

Drill string 12 may include a BHA 210 (FIG. 5) at its distal end that has a larger outer diameter than the inner diameter of seal assembly 43. Thus, seal assembly 43 can be engaged and carried to drilling rig 14 (and back) by riding atop the BHA. However, provided it has a sufficiently large outer diameter, any transport member carried by drill string 12, including a drill collar, sub, or simply a drill bit 212 (FIG. 5) may be used in lieu of a BHA for engaging and transporting seal assembly 43.

A tubular spacer 60 may be provided between BOP stack 21 and RCD 40 as necessary to accommodate, at step 154, the length of the BHA between the uppermost BOP wellbore closure device (e.g., blind rams) and the lowermost portion of the sealing element of RCD 40. Additional structural supports 61 may be provided align with tubular spacer 60 to carry and reinforce RCD 40.

At step 156, once the BHA is clear of the uppermost BOP closure device but before it reaches the lowermost portion of seal assembly 43, accommodated within tubular spacer 60 as necessary, BOP stack 21 is actuated to shut one or more of its closure devices and thereby fluidly isolate wellbore 32.

At step 158, any differential pressure across seal assembly 43 may be equalized. For example, passage 42 of RCD 40 may be selectively vented by a conduit 72 to a surge tank 70, which may collect and hold the pressurized well annular fluid. A pump 74 may also be provided at the seafloor to purge the fluid contents of passage 42 and tubular spacer 60 with seawater, collecting any well fluids in surge tank 70 to prevent contaminating body of water 11. To facilitate pressure equalization, as well as to enhance operation of RCD 40 during drilling operations, it is advantageous to have pressure sensors 76, 77 above and below seal assembly 43 to accurately determine the differential pressure.

At step 160, RCD clamp 44 is released via the actuator 45. HPU 50 may selectively operate actuator 45 via hydraulic conduit 55, and HPU 50 may be remotely controlled from the surface of body of water 11 by a communication link 80.

At step 162, drill string 12 is raised to the surface of body of water 11 by drilling rig 14. Because the BHA has a greater outer diameter than the inner diameter of seal assembly 43, seal assembly 43 is carried to offshore platform 19 by drill string 12 as it is tripped out.

Alternatively, should it be desired to completely remove RCD 40, clamp 44 is not released. Instead, a remotely operated vehicle (ROV) may be deployed to disconnect RCD 40, or a different remotely operated clamping device that connects RCD 40 to BOP stack 21 may be released. Then, the entire RCD 40 may be carried to offshore platform by drill string 12 in the same manner.

A replacement seal assembly 43 (or RCD 40, as the case may be) can be lowered into place at the seafloor by reversing the above steps, using a ROV as necessary to guide drill string 12 into position.

Referring back to FIG. 1, drilling system 10 may also include a drill string guide 90 carried atop RCD 40. Offshore platform 19 may experience surge, sway and yaw motions under the environmental conditions of tides, waves, wind, and currents. Additionally, drill string 12 is unconstrained as is passes from offshore platform 19 through body of water 11 and likewise encounter currents. Accordingly, drill string 12 is subject to lateral movement with respect to the location of wellhead 20 at the seafloor. Guide 90 functions as a fairlead to align drill string 12 with the common axis of RCD 40, BOP stack 21, and wellhead 20, thereby relieving stress and minimizing wear and tear on seal assembly 43. The upper end of guide 90 may have a wide, tapered opening to enhance engagement between guide 90 and drill string 12.

In addition to or as an alternative to supporting seal assembly 43 replacement as described above, pump 74 may be used to support well control operations and managed pressure drilling (MPD) techniques. For example, pump 74 may apply a controlled backpressure to the fluid in wellbore annulus 34, such as via passage 42 of RCD 40. However, other pressure sources may also be used for annular pressure control, including choke line 27.

At least one communication link 80 is provided between one or more locations at the surface of body of water 11 and one or more of BOP control pod 28, HPU 50, and pump 74, for control of one or more of BOP stack 21, RCD 40, and annulus 32 pressure, respectively.

In one or more embodiments, communication link 80 may be implemented by an umbilical 82. Umbilical 82 may include a number hydraulic, electrical and/or fiber optic lines, for example, including feed line 53 and choke and kill lines 27, 29. In one or more embodiments (not expressly illustrated), umbilical 82 extends from the seafloor to offshore platform 19. In another embodiment, to prevent entanglement of the umbilical 82 with the drill string 12, a floating vessel or apparatus 84, such as a drilling support ship, may be provided at the surface of body of water 11 at a distance separated from offshore platform 19.

In one or more embodiments (not expressly illustrated), communication link 80 may employ other remote telemetry technology, such as is commonly used with pipe lines and subsea production trees and wellheads. For example, communication link 80 may include an acoustic link operable through said body of water 11.

Figure 3:
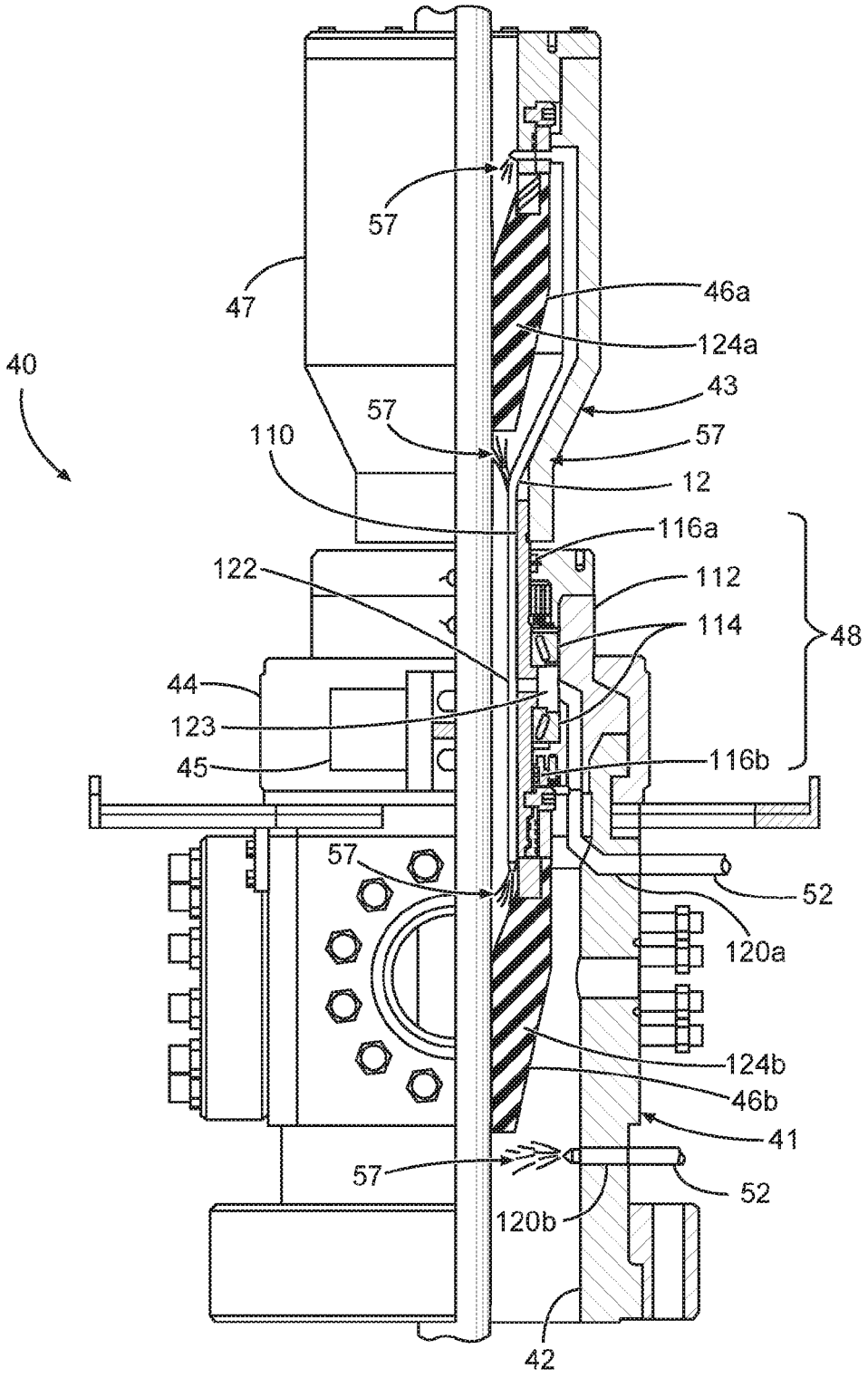
FIG. 3 is an elevation view of a rotating control device of FIG. 1 with a longitudinal quarter cut away to reveal internal structure, showing details of a removable seal assembly and lubrication flow path.

FIG. 3 is an elevation view in partial cross section of a RCD 40 according to an embodiment. RCD 40 is used to seal off wellbore annulus 34 (FIG. 1), which is in fluid communication with passage 42 formed within housing 41 of RCD 40. Housing 41 is sealed against the exterior wall of drill string 12 within passage 42, even while drill string 12 rotates and translates longitudinally therein. For this purpose, RCD 40 includes removable seal assembly 43, which includes one or more resilient annular sealing elements 46. If multiple sealing elements 46 are used, seal assembly 43 may include a shroud 47. To permit sealing elements 46 and shroud 47 to rotate as drill string 12 rotates, seal assembly 43 includes a bearing assembly 48, which may in turn include an inner carrier ring 110 that rotates within an outer carrier ring 112 using bearings 114 and seals 116. Inner carrier ring carries sealing elements 46 and shroud 47. Clamp 44 releasably secures outer carrier ring 112, and thereby the entire seal assembly 43 (with sealing elements 46, shroud 47 and bearing assembly 48), to housing 41.

RCD 40 may include one or more lubrication flow paths 120 for supplying bearings 114 and the sealing element 46/drill string 12 interface(s) with a supply of lubricant 57. Lubrication flow paths 120 fluidly connect at housing 41 to HPU 50 (FIG. 1) via lubrication conduits 52. In one or more embodiments, within housing 41, a first lubrication flow path 120*a* fluidly connects to a bearing region 123, demarcated between inner and outer carrier rings 110, 112 and between upper and lower seals 116*a*, 116*b*, for supplying bearings 114 with lubricant. Lubrication flow path 120*a* may include a manifold 122, which rotates with inner carrier ring 110 and which fluidly connects to bearing region 123 through one or more ports formed through inner carrier ring 110 Lubricant 57 is supplied to the outer wall of drill string 12 between upper and lower sealing elements 46*a*, 46*b* via manifold 122. Manifold 122 may also extend to the top of upper sealing element 46*a* for selectively supplying lubricant 57 to that location during downward travel of drill string 12. Manifold 122 may include nozzles or the like to direct lubricant 57 at the sealing element 46/drill string 12 interfaces. A second lubrication flow path 120*b* may be provided through housing 41 to selectively direct lubricant 57 to the bottom of lower sealing element 46*b* during upward movement of drill string 12. Although particular lubrication flow paths 120 are disclosed herein, a routineer will understand that a wide variety of lubrication flow paths may be suitable for a particular RCD, including lubrication flow paths with selectively isolable branches for selective lubrication.

Figure 4:
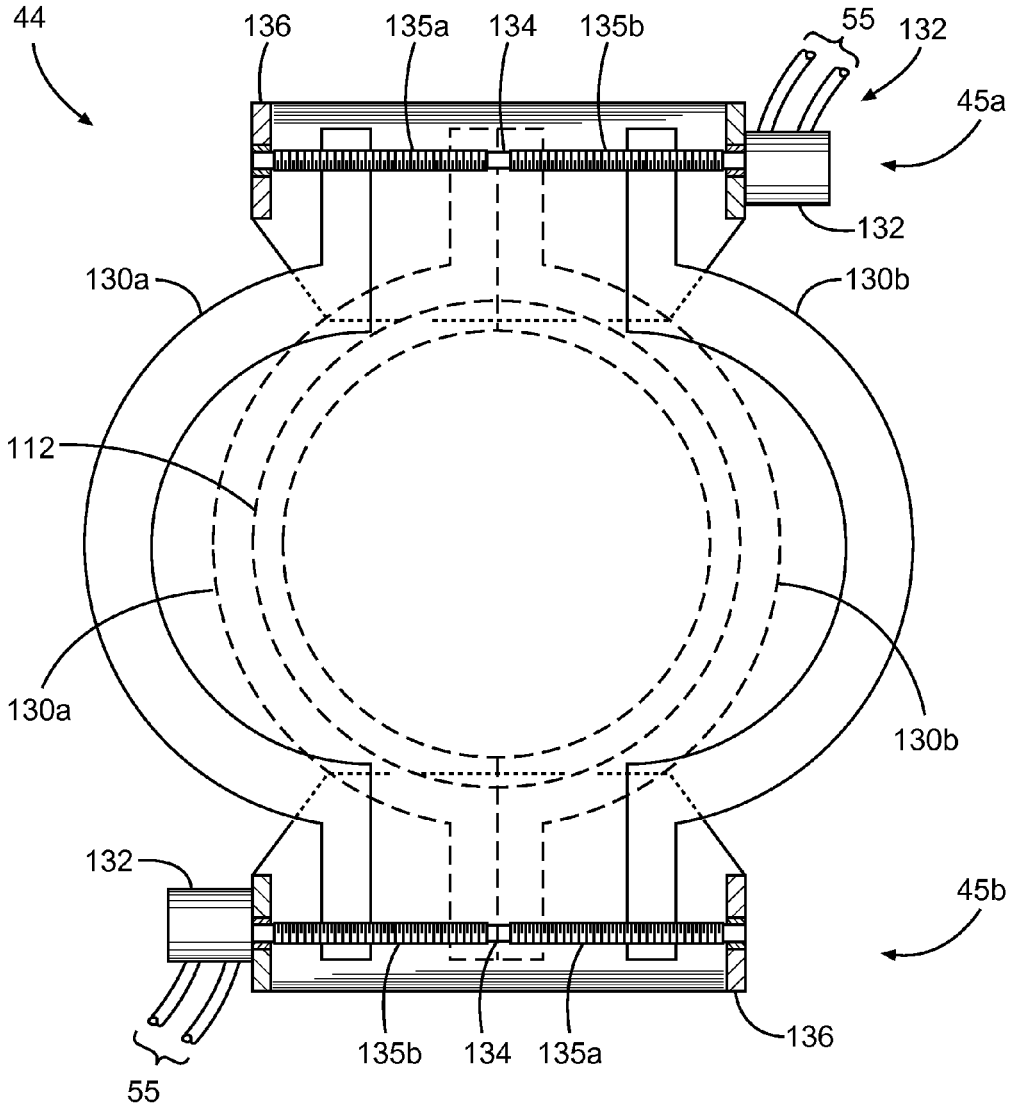
FIG. 4 is a plan view of a clamp of the rotating control device of FIG. 3 for removably connecting the seal assembly to the housing of the rotating control device.

FIG. 4 is a plan view of clamp 44 of RCD 40 according to an embodiment. Clamp 44 may include first and second movable clamping arms 130*a*, 130*b*. In the embodiment illustrated, clamping arms 130*a*, 130*b* are arcuate and are translatable between a clamped position (shown in broken line) in which they are in proximity or otherwise abut one another and a released position (shown in solid line) in which they are separated by a sufficient distance to allow outer carrier ring 112 to fit between them. However, in other embodiments (not illustrated), clamping arms may have other shapes and/or may pivot or tilt to provide clearance outer carrier ring 112 to be removed from RCD housing 41 (FIG. 3). Additionally, any number (including one) of clamping arms may be provided as appropriate.

In the embodiment illustrated, clamp 44 includes first and second actuators 45*a*, 45*b* connected so as to selectively move clamping arms 130*a*, 130*b*. Each actuator 45 may include a hydraulic motor 132 that rotates a lead screw 134. Each lead screw has opposite-hand thread sections 135*a*, 135*b* upon which clamping arms 130*a*, 130*b* are threaded. Each actuator may include a bracket 136 to support motor 132 and lead screw 134. Actuator 45 may be fluidly connected to HPU 50 (FIG. 1) by hydraulic conduits 55. In other embodiments, any number (including one) of actuators 45 may be provided, and actuator(s) 45 may include piston-cylinder arrangements or other suitable mechanisms.

Figure 5:
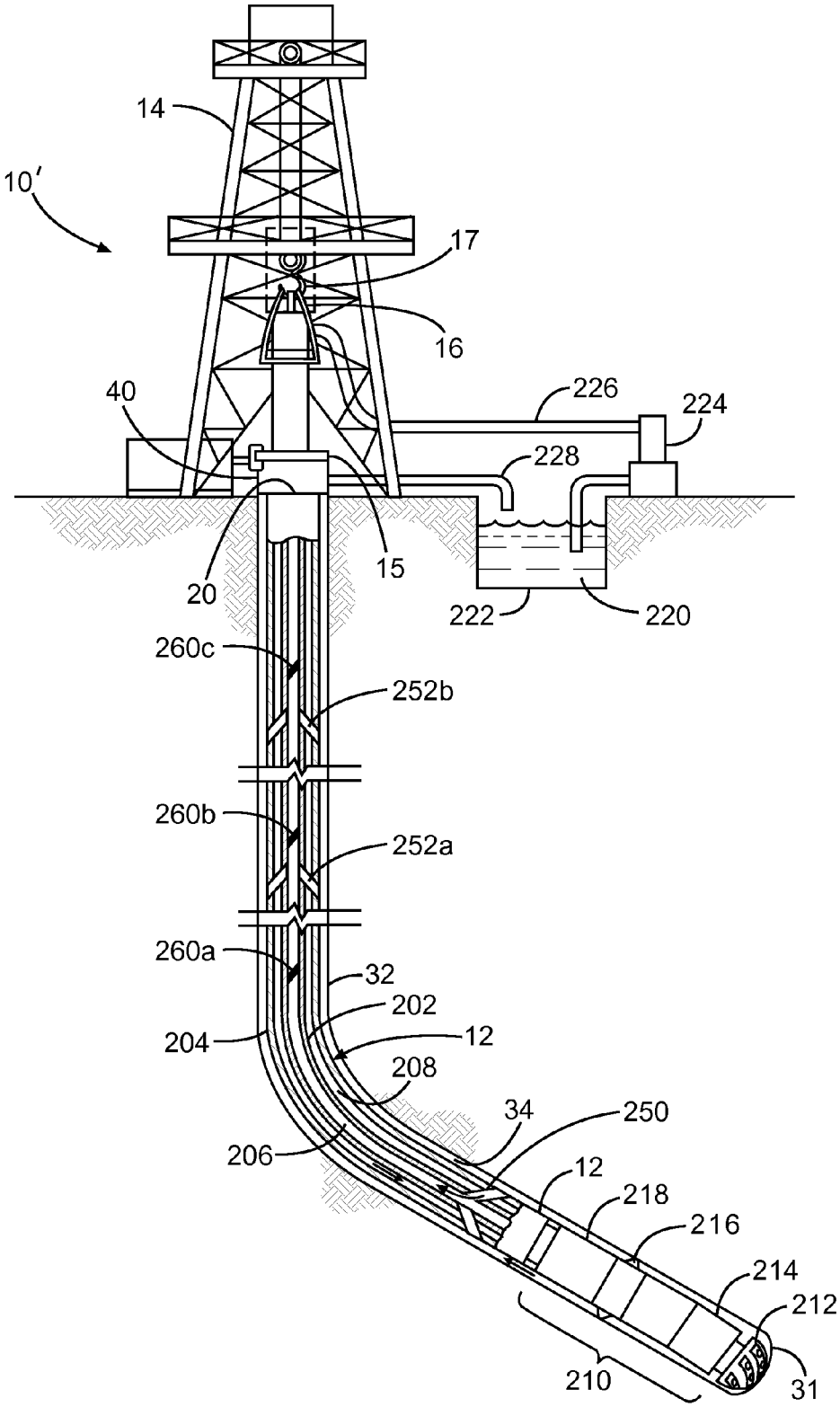
FIG. 5 is an elevation view in partial cross section of a dual drill string drilling system 10 according to an embodiment.

FIG. 5 is an elevation view in partial cross section of a dual drill string drilling system 10' according to one or more embodiments. As with drilling system 10 of FIG. 1, drilling system 10' of FIG. 5 includes drilling rig 14, which may be located on land or offshore. Drilling rig 14 may be located above well head 20 and may include rotary table 15, top drive 16, hoist 17, and other equipment necessary for drilling a wellbore in the earth. Blow out preventers (not expressly shown) and associated equipment may also be provided at well head 20. Drilling rig 14 suspends dual drill string 12 through RCD 40, wellhead 20, and into wellbore 32.

Dual drill string 12 includes an inner pipe 202 that is disposed within an outer pipe 204. Inner pipe 202 and outer pipe 204 may be eccentric or concentric. An annular outer flow channel 208 is defined between inner pipe 202 and outer pipe 204, and an inner flow channel 206 is defined within the interior of inner pipe 202. Wellbore annulus 34 is defined between the exterior of drill string 12 and the inside wall of wellbore 32.

The distal end of drill string 12 may include BHA 210 and rotary drill bit 212. BHA 210 may include a downhole mud motor 214, centralizer 216, and various other tools 218, such as those that provide logging or measurement data, orientation data, telemetry, etc. Drilling fluid 220 may be pumped from reservoir 222 by one or more drilling fluid pumps 224, through conduit 226, to the upper end of drill string 12 extending out of well head 20. The drilling fluid 220 then flows through outer flow channel 208 of drill string 12, through BHA 210, and exits from nozzles formed in rotary drill bit 212.

A distal crossover port 250 located near the distal end of drill string 12 fluidly connects annulus 34 with inner flow channel 206 during normal drilling operations. At bottom end 31 of wellbore 32, drilling fluid 220 may mix with formation cuttings and other downhole fluids and debris. The drilling fluid/cuttings mixture then flows upwardly through wellbore annulus 34, past BHA 210 and into inner flow channel 206 through the distal crossover port 250. The mixture continues to flow upwards through the inner flow channel 206 of drill string 12. Conduit 228 may return the fluid to reservoir 222, and various types of screens, filters and/or centrifuges (not expressly shown) may be provided to remove formation cuttings and other downhole debris prior to returning drilling fluid 220 to reservoir 222.

In a particular well pressure control operation, the upper end wellbore annulus 34 may be filled via RCD 40 with a well control fluid, for example, a high-density fluid to alter the density of fluid within annulus 34. The previous fluid displaced by the newly-introduced high-density fluid may be forced out of wellbore annulus 34 via distal crossover port 250 and inner flow channel 206. In an alternate well pressure control operation, by reversing fluid flow through inner flow channel 206, a high-density fluid may be pumped downward through inner pipe 202 and into wellbore annulus 34 through crossover port 250 near the distal end of drill string 12 to help fill the annulus. Displaced wellbore fluid may be recovered via RCD 40. Accordingly, dual drill string 12 may be raised or lowered within wellbore 32 while filling annulus 34 via distal crossover port 250 to facilitate filling the entire length of wellbore annulus 34.

However, according to an embodiment, one or more medial crossover ports 252 are provided at various intervals along dual drill string 12 in addition to distal crossover port 250. Crossover ports 250, 252 can be independently, remotely, and preferably repeatedly, opened and shut by using one or more conventional techniques. Accordingly, each crossover port 250, 252 includes a valve assembly with an actuator for operating the valve that can be remotely and independently controlled. The valve assembly may include a valve component such as a gate, flapper, ball, disc and sleeve, for example, that pivots, translates, or rotates between open and shut positions. The actuator causes the valve component to position between open and shut positions and may be controlled for example, by mud pulse telemetry, radio-frequency identification (RFID) tags, drop balls, or utilizing the inner and outer electrically conductive pipes, 202, 204 of dual string 12 as a communication bus. The actuator may be powered hydraulically by a drilling fluid differential pressure, or electrically from a battery, by generating electricity from a turbine rotated by a drilling fluid flow, or by utilizing dual string 12 as a pair of electrical conductors, for example. Additionally, other arrangements for remotely controlling and powering crossover ports 250, 252 may be used as appropriate.

Therefore, in the embodiment of FIG. 5, the entire volume of fluid within wellbore annulus 34 can be easily replaced without the necessity of running-in or tripping drill string 12 or having to pump high-density fluid all the way up wellbore 32. For example, crossover port 250 may be opened and crossover ports 252*a*, 252*b* may be shut. A high-density fluid can be pumped through inner flow channel 206 to fill the annulus from crossover port 250 to crossover port 252*a*, with the previous lighter-density fluid exiting at the top of wellbore 32 via RCD 40. Next, crossover port 250 is shut, and crossover port 252*a* is opened. Pumping is continued through inner flow channel 206 and crossover port 252*a* to fill annulus 34 with the high-density fluid until crossover port 252*b* is reached, and so on, up wellbore 32.

According to one or more embodiments, dual drill string 12 may include one or more one-way check valves 260 disposed within inner pipe 202 and intervaled along drill string 12. Check valves 260 may be oriented so as to check downward flow and thereby prevent heavy cuttings and earthen particular matter suspended within drilling fluid 220 in inner flow channel 206 from settling all the way to the bottom of drill string 12 during prolonged periods of non-circulation. In some embodiments, may be simple mechanical valves, and in other embodiments, check valves 260 may be remotely actuated to an opened position to allow downward flow through inner flow channel 206, such as for well pressure control operations described above. In the latter embodiments, check valves 260 may be controlled and powered in the same manner as described above with respect to crossover ports 250, 252. Check valves 260 may be ported or otherwise provide small fluid channels (not illustrated) to provide pressure communication and limited flow capability between bottom 31 of wellbore 32 and the upper end of drill string 12.

Figure 6:
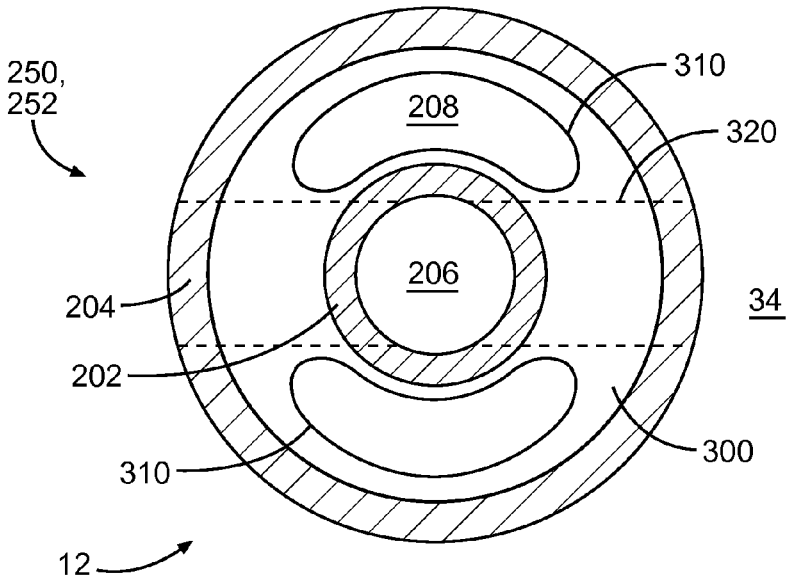
FIG. 6 is a transverse cross section of a dual drill string taken along line 6-6 of FIG. 7, looking down upon a crossover port according to an embodiment.
Figure 7:
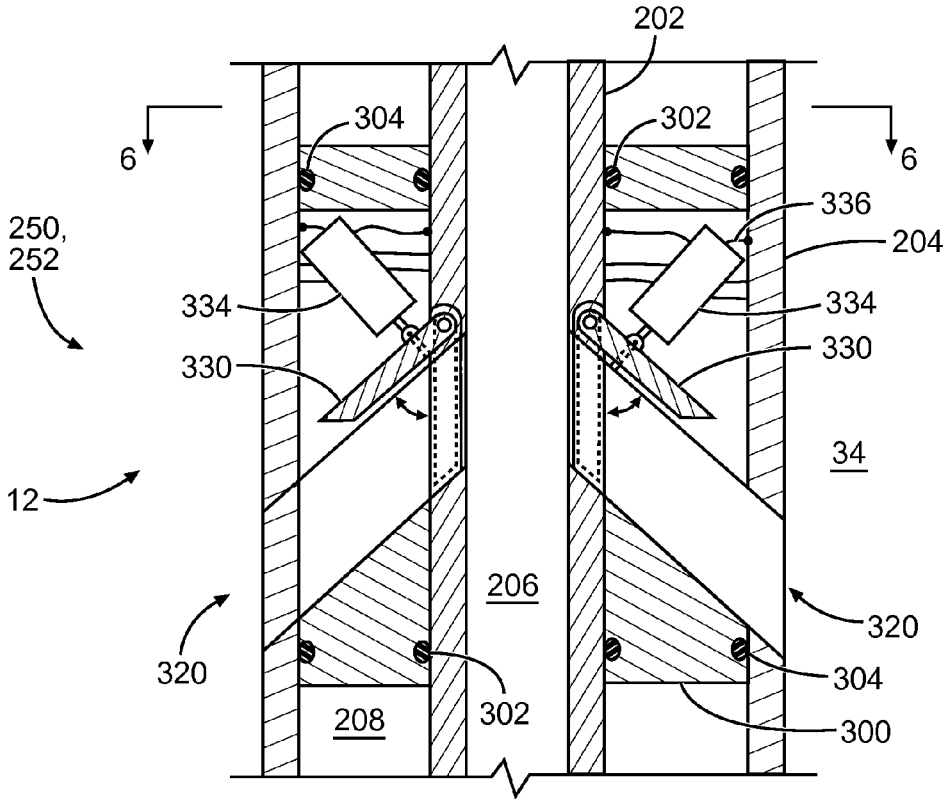
FIG. 7 is an axial cross section of the crossover port of FIG. 6, showing a valve assembly and actuator arranged for remote, independent operation.

FIG. 6 is a transverse cross section of dual drill string 12 looking down upon a crossover port 250, 252 according to an embodiment. FIG. 7 is an axial cross section of the crossover port 250, 252 of FIG. 6. Referring to both FIGS. 6 and 7, crossover port 250, 252 may include a cylindrical body 300 positioned within outer flow channel 208 of dual drill string 12 and sealing with seals 302, 304 against the outer wall of inner pipe 202 and the inner wall of outer pipe 204, respectively.

One or more apertures 310 longitudinally formed through body 300 fluidly couples outer flow channel 208 above and below body 300. One or more apertures 320 radially formed through body 300, inner pipe 202, and outer pipe 204 selectively fluidly couples inner flow channel 206 with wellbore annulus 34. Body 300 may be keyed to inner and outer pipes 202, 204 so as to maintain proper rotational alignment.

A valve assembly is provided, which in the embodiment illustrated in FIGS. 6 and 7 includes flappers 330 that pivot between open positions (shown in solid line) and shut positions (shown in broken line) for selective isolation of aperture 320. However, the valve assembly may include any suitable valve component such as a gate, flapper, ball, disc and sleeve, for example, that pivots, translates, or rotates between open and shut positions. Flappers 330 are positioned by electrical actuators 334, such as solenoids. However, any suitable actuator, including electrical, mechanical, hydraulic, pneumatic, or the like, may be used.

In certain embodiments, electrical power and device-addressable control may be transmitted to actuators 300 by inner pipe 202 and outer pipe 204 along the length of drill string 12. Actuators 300 may be electrically connected to inner and outer pipes 202, 204 with leads 336. Inner pipe 202 may be the "hot" conductor and outer pipe 204 may be grounded, because outer pipe 204 is likely to be in conductive contact with the grounded drilling rig 14 (FIG. 5). The outer wall of inner pipe 202 and/or the inner wall of outer pipe 204 may be coated with an electrical insulating material (not expressly shown) to prevent short circuiting of the inner pipe 202 through the drilling fluid or other contact points to the outer pipe 204. Examples of dielectric insulating materials include polyimide, polytetrafluoroethylene or other fluoropolymers, nylon, and ceramic coatings. Body 300 may similarly be made of ceramic material or a metal alloy with a dielectric insulating coating. Ceramics offer a high erosion resistance to flowing sand, cuttings, junk and other particulate matter. However, other forms for providing of communication and power to actuators 300 may be used as appropriate, including mud pulse telemetry, radio-frequency identification (RFID) tags, drop balls, and the like.

Figure 9:
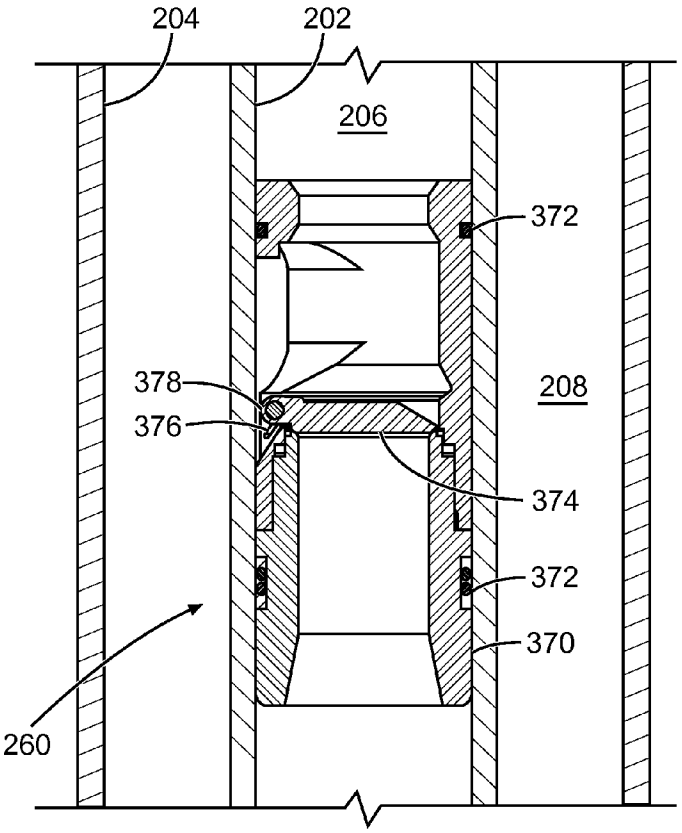
FIG. 9 is an axial cross section of the dual drill string and check valve assembly of FIG. 8, showing the check valve assembly in a shut position.
Figure 8:
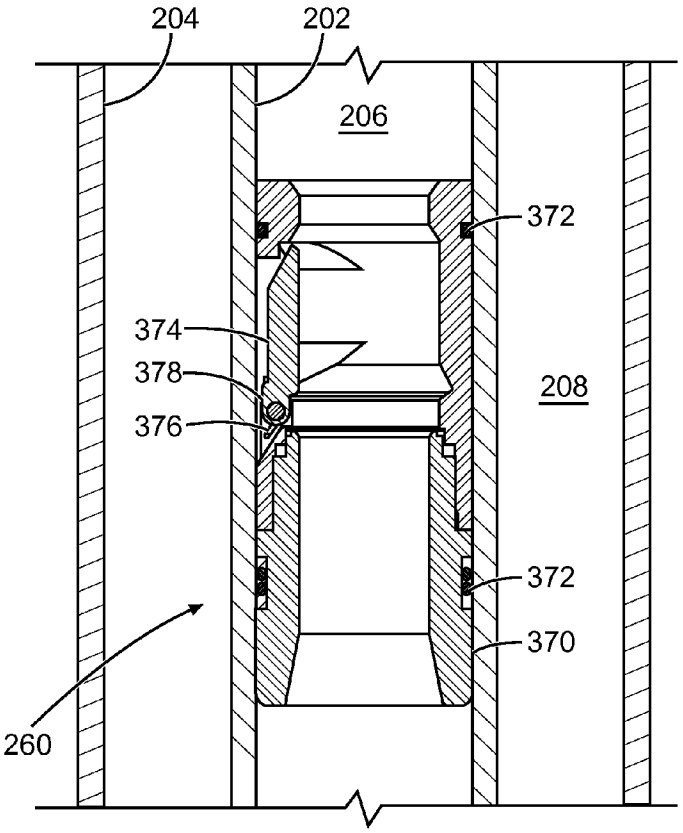
FIG. 8 is an axial cross section of a portion of the dual drill string of FIG. 5, showing a check valve assembly positioned within the inner flow channel and in an open position.

FIGS. 8 and 9 are axial cross sections of a check valve 260 of FIG. 5 according to an embodiment. Check valve 260 may include a body 370 that is positioned and sealed within inner pipe 202 using seals 372. A pivoting flapper 374 allows flow in an upward direction as shown in FIG. 8 and prevents flow in a downward direction as shown in FIG. 9. Flapper may be urged into the shut position of FIG. 9 by a toroidal spring 376 wound about a pivot pin 378. Fluid flow of a sufficient pressure will overcome the shutting force of spring 376. In another embodiment, check valve 260 may include an actuator, such as disclosed with respect to crossover ports 250, 255, for allowing controlled, selective, remote operation of check valve 260.

In summary, drilling systems and methods for drilling a wellbore have been described. Embodiments of a drilling system may have: A drilling rig; a concentric dual drill pipe string carried by the drilling rig and extending into a wellbore, the concentric dual drill pipe string including an inner pipe disposed within an outer pipe, a region within the wellbore and external to an outer wall of the string defining an annulus; a first valve disposed along the string selectively fluidly coupling an interior of the inner pipe with the annulus; and a second valve disposed along the string selectively fluidly coupling an interior of the inner pipe with the annulus; wherein the first and second valves can be independently and remotely actuated. Embodiments of an offshore drilling system may have: A wellhead on a seafloor of a body of water, the wellhead defining a passage; a rotating control device having a housing carried atop the wellhead, the housing defining a passage in fluid communication with the passage of the wellhead; an offshore platform disposed above a surface of the body of water; a concentric dual drill pipe string carried by the platform and extending through the passage of the rotating control device into the passage of the wellhead, the wellhead and the string defining an annulus therebetween, the rotating control device including a sealing element that dynamically seals against an outer wall of the string so as to fluidly isolate the annulus from the body of water, the outer wall of the string above the rotating control device being in contact with the body of water; a hydraulic power unit near the seafloor and coupled to the rotating control device so as to supply a lubricant to the sealing element; a source of pressurized fluid selectively fluidly coupled to the annulus; and at least one communication link operable between a location at the surface of the body of water and at least one of the hydraulic power unit and the source of pressurized fluid. Embodiments of a method for drilling a wellbore may include: Providing a blowout preventer at a seafloor of a body of water; providing a rotating control device carried above the blowout preventer, the rotating control device including a housing and a releasable seal assembly characterized by an inner diameter; providing a drill string extending from a surface of the body of water through the rotating control device and blowout preventer into the wellbore, the drill string carrying a drill bit at a distal end, the drill string carrying a transport member characterized by an outer diameter that is greater than the inner diameter of the seal assembly; raising the drill string to a position where the drill bit is higher than the blowout preventer and the transport member is lower than the seal assembly; then shutting a closure device of the blowout preventer to fluidly isolate the wellbore; equalizing pressure across the seal assembly; remotely unclamping the seal assembly from the housing; and then raising the drill string to the surface, the transport member carrying the seal assembly.

Any of the foregoing embodiments may include any one of the following elements or characteristics, alone or in combination with each other: A bottom hole assembly carried at a distal end of the string; a blowout preventer carried atop the wellhead at a position below the rotating control device, the blowout preventer having a passage formed therethrough that is in fluid communication with the passages of the wellhead and the rotating control device, the blowout preventer including a closure device arranged so as to selectively isolate the passage of the wellhead from the passage of the rotating control device; a clamp included with the rotating control device so as to selectively connect the sealing element to the housing of the rotating control device; a tubular spacer carried atop the blowout preventer at a position below the rotating control device, the spacer having an axial length great enough so that the bottom hole assembly can be positioned between the closure device of the blowout preventer and the sealing element of the rotating control device; the hydraulic power unit is arranged so as to actuate the clamp; the clamp is remotely controllable from the location at the surface of the body of water; a guide carried atop the rotating control device; the guide has a tapered upper end; the source of pressurized fluid includes a pump disposed at the seafloor and selectively fluidly coupled to the annulus; the pump is remotely controllable from the location at the surface of the body of water; the source of pressurized fluid includes a choke line extending between a point at the surface of the body of water and the seafloor, the choke line being selectively fluidly coupled to the annulus; the choke line is connected to a blowout preventer that is carried atop the wellhead at a position below the rotating control device; a lubrication flow path formed through the rotating control device in fluid communication with the outer wall of the string at or near the sealing element, the lubrication flow path being selectively fluidly coupled with the hydraulic power unit; the hydraulic power unit is arranged to deliver a quantity of the body of water through the lubrication flow path to the outer wall of the string; a tank disposed at the seafloor and containing a volume of lubricant, the tank being selectively fluidly coupled to the hydraulic power unit, the hydraulic power unit being arranged to deliver a quantity of the lubricant through the lubrication flow path to the outer wall of the string; a lubricant line extending between a point at the surface of the body of water and the seafloor, the lubricant line being selectively fluidly coupled to the hydraulic power unit, the hydraulic power unit being arranged to deliver a quantity of a lubricant from the lubricant line through the lubrication flow path to the outer wall of the string; a tank disposed at the seafloor and selectively fluidly coupled to the passage of the rotating control device for transferring a fluid between the passage of the rotating control device and the tank; the location at the surface of the body of water is at the offshore platform; a floating vessel disposed at the surface of the body of water, wherein the location at the surface of the body of water is at the floating vessel; an umbilical extending from the floating vessel to the at least one of the hydraulic power unit and the source of pressurized fluid, the at least one communication link provided via the umbilical; a blowout preventer carried atop the wellhead at a position below the rotating control device; a choke line and a kill line each extending from the floating vessel to the blowout preventer, the choke and kill lines being selectively fluidly coupled to the blowout preventer; a first pressure sensor included with the rotating control device and positioned for measuring a pressure at a first point above the sealing element; a second pressure sensor included with the rotating control device and positioned for measuring a pressure at a second point below the sealing element; the first and second pressure sensors are coupled to the at least one communication link for communication with location at the surface of the body of water; at least one communication link operable between the first and second valves and the drilling rig for independently and remotely actuating the first and second valves from the drilling rig; at least one communication link operable between the first and second valves and the drilling rig for independently and remotely actuating the first and second valves from the drilling rig; a plurality of check valves disposed at a plurality of points along the string within the inner pipe so as to prevent downhole flow within the inner pipe; providing a tubular spacer between the blowout preventer and the rotating control device; accommodating the transport member within the tubular spacer; and said transport member is a bottom hole assembly.

The Abstract of the disclosure is solely for providing the patent office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A drilling system comprising:

a wellhead on a seafloor of a body of water, the wellhead defining a passage;

a rotating control device having a housing carried atop the wellhead, the housing defining a passage in fluid communication with the passage of the wellhead;

an offshore platform disposed above a surface of the body of water;

a concentric dual drill pipe string carried by the platform and extending through the passage of the rotating control device into the passage of the wellhead, the wellhead and the string defining an annulus therebetween, the rotating control device including a sealing element that dynamically seals against an outer wall of the string so as to fluidly isolate the annulus from the body of water, the outer wall of the string above the rotating control device being in contact with the body of water;

a hydraulic power unit near the seafloor and coupled to the rotating control device so as to supply a lubricant to the sealing element;

a source of pressurized fluid selectively fluidly coupled to the annulus;

at least one communication link operable between a location at the surface of the body of water and at least one of the hydraulic power unit and the source of pressurized fluid a bottom hole assembly carried at a distal end of the string;

a blowout preventer carried atop the wellhead at a position below the rotating control device, the blowout preventer having a passage formed therethrough that is in fluid communication with the passages of the wellhead and the rotating control device, the blowout preventer including a closure device arranged so as to selectively isolate the passage of the wellhead from the passage of the rotating control device; and a tubular spacer carried atop the blowout preventer at a position below the rotating control device, the spacer having an axial length great enough so that the bottom hole assembly can be positioned between the closure device of the blowout preventer and the sealing element of the rotating control device.

2. The drilling system of claim 1 further comprising a clamp included with the rotating control device so as to selectively connect the sealing element to the housing of the rotating control device.

3. The drilling system of claim 2 wherein:

the hydraulic power unit is arranged so as to actuate the clamp; and the clamp is remotely controllable from the location at the surface of the body of water.

4. The drilling system of claim 2 further comprising:

a tank disposed at the seafloor and selectively fluidly coupled to the passage of the rotating control device for transferring a fluid between the passage of the rotating control device and the tank.

5. The drilling system of claim 1 further comprising:

a guide carried atop the rotating control device.

6. The drilling system of claim 5 wherein:

the guide has a tapered upper end.

7. The drilling system of claim 1 wherein the source of pressurized fluid further comprises:

a pump disposed at the seafloor and selectively fluidly coupled to the annulus; wherein the pump is remotely controllable from the location at the surface of the body of water.

8. The drilling system of claim 1 wherein the source of pressurized fluid further comprises:

a choke line extending between a point at the surface of the body of water and the seafloor, the choke line being selectively fluidly coupled to the annulus.

9. The drilling system of claim 8 wherein:

the choke line is connected to a blowout preventer that is carried atop the wellhead at a position below the rotating control device.

10. The drilling system of claim 1 wherein:

a lubrication flow path formed through the rotating control device in fluid communication with the outer wall of the string at or near the sealing element, the lubrication flow path being selectively fluidly coupled with the hydraulic power unit.

11. The drilling system of claim 10 wherein:

the hydraulic power unit is arranged to deliver a quantity of the body of water through the lubrication flow path to the outer wall of the string.

12. The drilling system of claim 10 further comprising:

a tank disposed at the seafloor and containing a volume of lubricant, the tank being selectively fluidly coupled to the hydraulic power unit, the hydraulic power unit being arranged to deliver a quantity of the lubricant through the lubrication flow path to the outer wall of the string.

13. The drilling system of claim 10 further comprising:

a lubricant line extending between a point at the surface of the body of water and the seafloor, the lubricant line being selectively fluidly coupled to the hydraulic power unit, the hydraulic power unit being arranged to deliver a quantity of a lubricant from the lubricant line through the lubrication flow path to the outer wall of the string.

14. The drilling system of claim 1 wherein:

the location at the surface of the body of water is at the offshore platform.

15. The drilling system of claim 1 further comprising:

a floating vessel disposed at the surface of the body of water, wherein the location at the surface of the body of water is at the floating vessel.

16. The drilling system of claim 1 further comprising:

an umbilical extending from the floating vessel to the at least one of the hydraulic power unit and the source of pressurized fluid, the at least one communication link provided via the umbilical.

17. The drilling system of claim 1 further comprising:

a blowout preventer carried atop the wellhead at a position below the rotating control device; and a choke line and a kill line each extending from the floating vessel to the blowout preventer, the choke and kill lines being selectively fluidly coupled to the blowout preventer.

18. The drilling system of claim 1 further comprising:

a first pressure sensor included with the rotating control device and positioned for measuring a pressure at a first point above the sealing element; and a second pressure sensor included with the rotating control device and positioned for measuring a pressure at a second point below the sealing element; wherein the first and second pressure sensors are coupled to the at least one communication link for communication with location at the surface of the body of water.

19. A method for drilling a subsea wellbore, comprising:

providing a blowout preventer at a seafloor of a body of water;

providing a rotating control device carried above the blowout preventer, the rotating control device including a housing and a releasable seal assembly characterized by an inner diameter;

providing a drill string extending from a surface of the body of water through the rotating control device and blowout preventer into the wellbore, the drill string carrying a drill bit at a distal end, the drill string carrying a transport member with an outer diameter that is greater than the inner diameter of the seal assembly;

raising the drill string to a position where the drill bit is higher than the blowout preventer and the transport member is lower than the seal assembly; then shutting a closure device of the blowout preventer to fluidly isolate the drill bit and the transport member between the closure member of the blowout preventer and the seal assembly of the rotating control device;

equalizing pressure across the seal assembly;

remotely unclamping the seal assembly from the housing; and then raising the drill string to the surface, the transport member carrying the seal assembly.

20. The method of claim 19 further comprising:

providing a tubular spacer between the blowout preventer and the rotating control device; and accommodating the transport member within the tubular spacer.

21. The method of claim 20 wherein:

said transport member is a bottom hole assembly.

* * * * *